US005376893A

United States Patent [19]

Etievant et al.

[11] Patent Number: 5,376,893

[45] Date of Patent: Dec. 27, 1994

[54] RESONANT CAVITY ELECTRON ACCELERATOR

[75] Inventors: Claude Etievant, Versailles; Michel Roche, Dijon, both of France

[73] Assignee: Commissariat a l'Energie Atomique, Paris, France

[21] Appl. No.: 967,436

[22] Filed: Oct. 28, 1992

[30] Foreign Application Priority Data

Nov. 28, 1991 [FR] France ..... 91 14709

[51] Int. Cl.[5] ..... F26B 17/00

[52] U.S. Cl. ..... 315/501; 315/507; 315/5.41

[58] Field of Search ..... 328/233, 234; 315/5.41; 313/62; 250/396 R, 493.1; 372/2, 69

[56] References Cited

U.S. PATENT DOCUMENTS

| | | | |
|---|---|---|---|
| 3,349,335 | 10/1967 | Crowley-Milling | 328/233 |
| 4,016,499 | 4/1977 | Budker et al. | 328/233 |
| 4,287,488 | 9/1981 | Brau et al. | 372/2 |
| 4,323,857 | 4/1982 | Brau et al. | 372/2 |
| 4,393,441 | 7/1983 | Enge | 363/61 |
| 5,095,486 | 3/1992 | Etievant | 372/2 |
| 5,107,221 | 4/1992 | N'Guyen et al. | 328/233 |

FOREIGN PATENT DOCUMENTS

| | | |
|---|---|---|
| 0345769 | 12/1989 | European Pat. Off. . |
| 0410880 | 1/1991 | European Pat. Off. . |
| 2065363 | 6/1981 | United Kingdom . |
| WO88/09597 | 12/1988 | WIPO . |

OTHER PUBLICATIONS

Nuclear Instruments & Methods in Physics Research, vol. A298, No. 1/3, pp. 93–101, Dec. 1, 1990, T. Weiland, et al., "Status and Future Developments of the Wake Field Transformer Experiment".

*Primary Examiner*—Donald J. Yusko
*Assistant Examiner*—Vip Patel
*Attorney, Agent, or Firm*—Oblon, Spivak, McClelland, Maier & Neustadt

[57] ABSTRACT

An electron accelerator for accelerating a first electron beam includes a resonant cavity, a source of electromagnetic energy for supplying the resonant cavity at a resonant frequency of the resonant cavity and for forming a second electron beam and injecting the second electron beam into the resonant cavity. The second electron beam is decelerated by the electromagnetic fields of the resonant cavity and the first electron beam is in phase opposition to the second electron beam.

12 Claims, 7 Drawing Sheets

88
86
80
58
54
66
72
68
74
70
76
56
48
64
78
56
60
50
62
52
62
84
82
90

RESONANT CAVITY ELECTRON ACCELERATOR

BACKGROUND OF THE INVENTION

1. Field of the Invention

The present invention relates to a resonant cavity electron accelerator.

It has uses in the irradiation of various substances such as agro-alimentary products, either directly by electrons, or by X-rays obtained by conversion on a heavy metal target.

2. Description of the Background

A resonant cavity electron accelerator is already known from documents (1) to (3) which, like the other documents cited hereinafter, are listed at the end of the present description.

A specific embodiment of such a known accelerator called the "Rhodotron" (registered trade mark) is diagrammatically shown in longitudinal sectional form in FIG. 1 and in cross-section in FIG. 2. It comprises a high frequency source SHF, an electron source K, a coaxial cavity CC and two electron deflectors D1 and D2. The coaxial cavity CC is formed by an external cylindrical conductor 10 and an internal cylindrical Conductor 20, as well as two flanges 31 and 32. Said cavity has an axis A and a median plane Pm perpendicular to the axis A.

Among all the possible resonance modes of such a cavity, there is one, the so-called fundamental mode of the transverse electric type, for which the electrical field E is purely radial in the median plane and decreases on either side of the median plane and is then eliminated on the flanges 31 and 32. Conversely, the magnetic field H is at a maximum along the flanges and is eliminated in the median plane on changing direction.

The cavity CC is supplied by the high frequency source SHF using a loop 34. The electron source K emits an electron beam Fe, which is contained in a plane perpendicular to the axis of the coaxial cavity CC, the plane Pm in the example shown in FIG. 2. This plane meets the axis of the coaxial cavity at a point 0. The electron beam Fe penetrates the cavity CC through an opening 11 and traverses the cavity CC in accordance with a first diameter d1 of the external conductor 10. The internal conductor 20 has two openings 21, 22, which are diametrically opposite and which are successively traversed by the beam.

The electron beam is accelerated by the electrical field if the phase and frequency conditions are satisfied (said electrical field must remain in a direction opposite to the speed of the electrons). The accelerated beam then passes out of the coaxial cavity CC through an opening 12, which is diametrically opposite to the opening 11 and is then deflected by the deflector D1. The beam is reintroduced into the cavity CC by an opening 13 and then follows a second diameter D2 and undergoes a second acceleration in the coaxial cavity CC. It passes out through an opening 14, which is diametrically opposite to the opening 13.

On passing out, the beam is again deflected by the deflector d2 and reintroduced into the coaxial cavity CC by an opening 15. It then follows a third diameter d3 and undergoes a third acceleration and then passes out of the coaxial cavity CC via an opening 16 diametrically opposite to the opening 15.

Thus, the Rhodotron (registered trade mark) can be designed in such a way that the electron beam which it accelerates reenters and exits the coaxial cavity CC a larger number of times.

FIG. 3 diagrammatically shows a constructional embodiment of the high frequency source SHF. which makes it possible to supply the cavity CC with high frequency electromagnetic energy.

The source SHF of FIG. 3 comprises a power oscillator tube 36, a pilot oscillator 38, which emits a high frequency signal for controlling the grid of the tube 36 after having been amplified by an amplifier 40, a resonant cavity 42 to which is coupled the plate of the tube 36 and another resonant cavity 44 which adapts the impedance of the source SHF to a transmission line 46, which makes it possible to couple the source SHF to the coaxial cavity CC by means of the coupling loop 34. Such a source SHF is relatively complex and costly and gives rise to reliability problems.

SUMMARY OF THE INVENTION

The present invention aims at obviating these disadvantages. For this purpose, the present invention proposes a resonant cavity electron accelerator in which use is made of an electron beam for supplying the resonant cavity with electromagnetic energy, said electron beam being injected at suitable times into the cavity so as to give up its energy to the resonant cavity.

More specifically, the present invention relates to an electron accelerator for accelerating a first electron beam and comprising at least one resonant cavity and means for supplying said cavity with an electromagnetic field at a resonant frequency of said cavity, said accelerator being characterized in that the cavity supply means incorporate means for forming a second electron beam and for injecting said second beam into the cavity, in the form of pulses, at times where the cavity functions in deceleration for the electrons of the second beam and in that the accelerator also has means for the formation of the first beam and for injecting said first beam into the cavity, in the form of pulses, in phase opposition to the second beam and following a trajectory separate from that of the second beam.

Thus, in the accelerator according to the invention, the resonant cavity is maintained solely by the energy taken from the second electron beam or generating beam and the operation of the accelerator requires no HF power supply source, unlike in the case of the Rhodotron (registered trade mark) shown in FIGS. 1 and 2.

The present invention makes it possible to increase the efficiency of the accelerator, and to simplify the accelerator, and improve its reliability and significantly reduce costs.

This becomes all the more interesting with a rise in the power required from the accelerator. Obviously, the accelerator according to the invention is provided for supplying the first beam, when the latter passes out of the accelerator, an energy higher than that of the generating beam when it enters said accelerator.

It is also pointed out that in order that the accelerator functions, it is firstly necessary to fill the resonant cavity with electromagnetic energy by means of the generating beam, but that said filling takes place in a very short time of approximately a fraction of a millisecond.

Preferably, the duration of the pulses of the first and second electron beams, during their in]action, is at the most equal to approximately 1/10 of the period of the electromagnetic field.

As will be shown hereinafter, such narrow pulses are preferred for phase reasons with respect to the electromagnetic field in the cavity, because there is an optimum phase for obtaining a good deceleration of the generating beam and a good acceleration of the first beam which it is wished to accelerate.

Preferably, the energy of the electrons of the second beam, during the injection thereof, exceeds the energy threshold below which said electrons remain trapped in the cavity. This avoids the formation of a disturbing plasma in the resonant cavity.

According to a special embodiment of the accelerator according to the invention, the means for forming and injecting the first and second electron beams incorporate electrostatic accelerating tubes and at least one high voltage generator for pre-accelerating the first beam and for accelerating the second beam. Said high voltage generator can be a high voltage source with electron voltage multiplication of the Greinacher type.

According to a first embodiment of the accelerator according to the invention, the resonant cavity comprises an external cylindrical conductor and an internal cylindrical conductor, which are coaxial and have openings for the introduction into and extraction from the cavity of the first and second electron beams and the accelerator also comprises at least one electron deflector able to deflect an electron beam which has traversed the cavity in accordance with one diameter and reinjects said electron beam into the cavity in accordance with another diameter.

Use is then made of a resonant cavity like a Rhodotron (registered trade mark).

In this case, according to a special embodiment, the external cylindrical conductor can have an opening for the introduction into the cavity of the second electron beam, the internal cylindrical conductor then having an opening facing the opening of the external cylindrical conductor, the accelerator also having means for receiving the second electron beam and which are located within the internal cylindrical conductor facing its opening.

Then, the generating beam does not completely traverse the resonant cavity and instead performs a so-called "half-passage" in said cavity, because means are provided for receiving it within the internal conductor of said cavity.

According to an advantageous embodiment of the accelerator according to the invention using coaxial cylindrical conductors and electrostatic accelerating tubes, said accelerating tubes are positioned facing openings of the external cylindrical conductor which are adjacent to one another.

It is then possible to use a single high voltage generator for these two accelerating tubes, which reduces the costs of the accelerator.

In this case, the accelerator can also comprise a tight enclosure in which are placed the electrostatic accelerating tubes and the high voltage generator and which is pressurized by a gas forming a dielectric.

According to a second special embodiment of the accelerator according to the invention, said accelerator comprises a linear accelerating structure with at least one resonant cavity and the first and second electron beams are injected into said structure respectively by one end of said structure and by its other end.

According to a third embodiment, the resonant cavity comprises an internal cylindrical conductor and an external cylindrical conductor, which are coaxial, the external cylindrical conductor having two diametrically opposite openings, the internal cylindrical conductor also having two diametrically opposite openings aligned with the openings of the external cylindrical conductor and the first electron beam and second electron beam are injected into the cavity respectively by one of the openings of the external conductor and by the other opening thereof.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
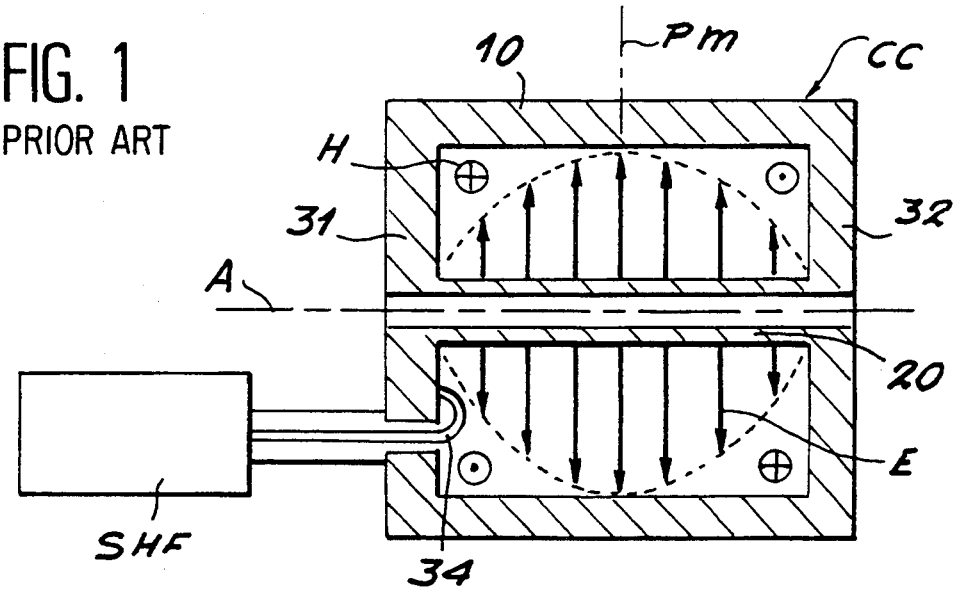
FIG. 1 PRIOR ART
FIG. 1 A diagrammatic, longitudinal sectional view of a known and already described resonant cavity accelerator.
Figure 2:
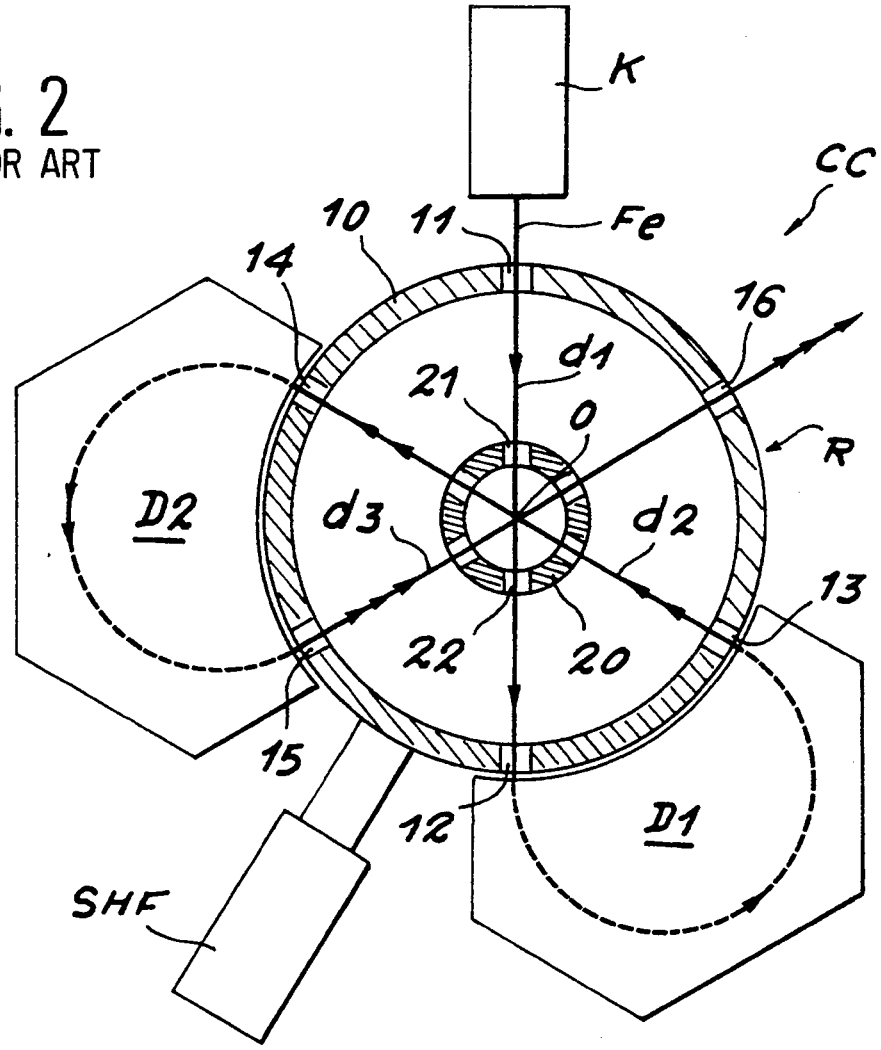
FIG. 2 PRIOR ART
FIG. 2 A cross-sectional view of the already described accelerator of FIG. 1.
Figure 3:
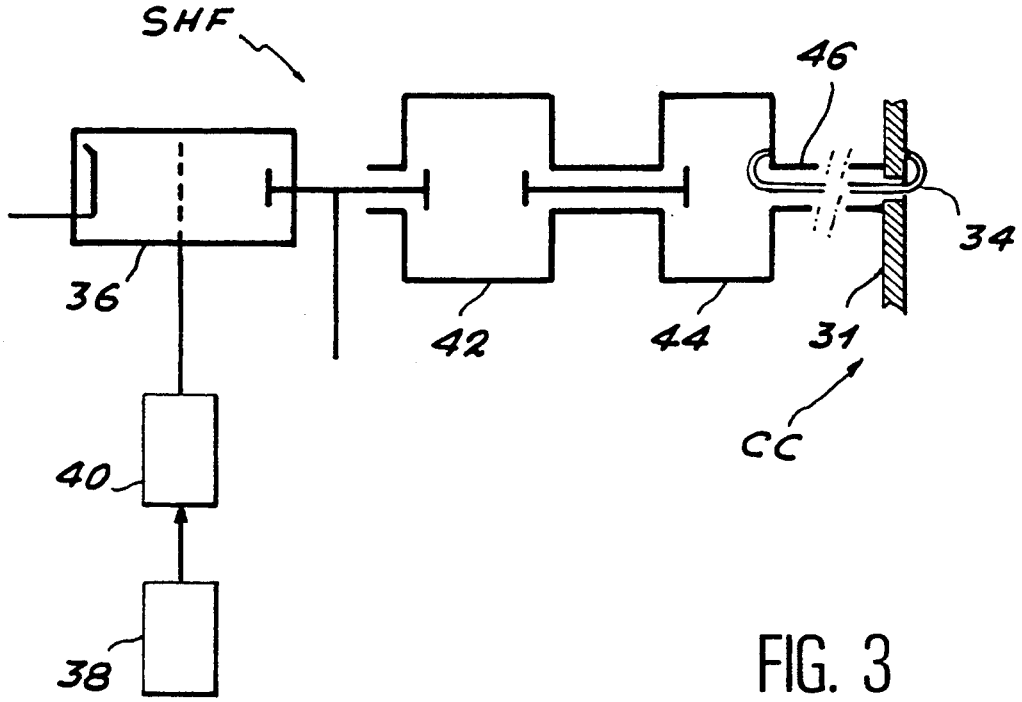
FIG. 3 PRIOR ART
FIG. 3 A diagrammatic view of a known high frequency source making it possible to supply electromagnetic energy to the resonant cavity of the accelerator of FIGS. 1 and 2 and which has already been described.
Figure 4:
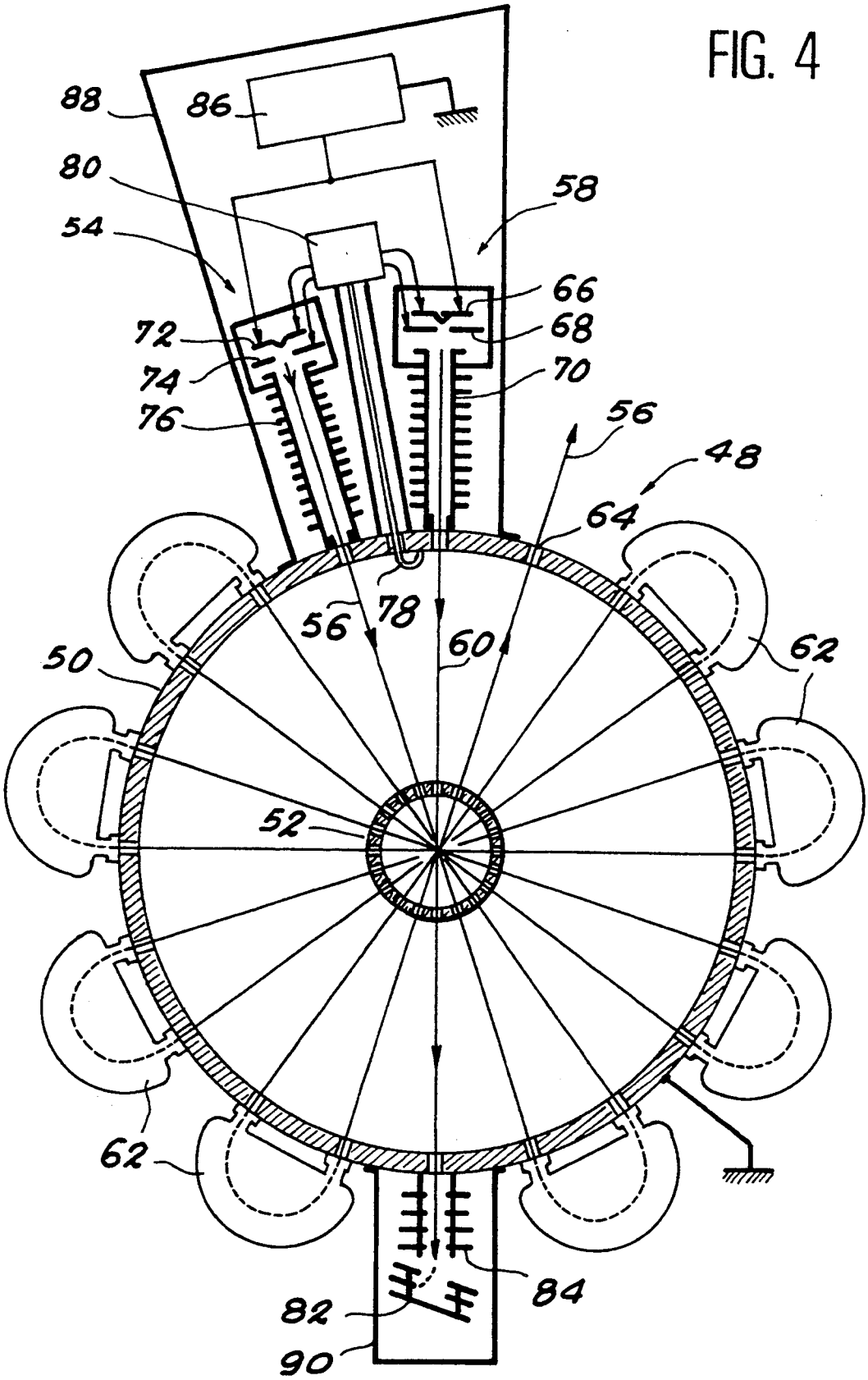
FIG. 4 A diagrammatic view of a special embodiment of the accelerator according to the invention using a resonant cavity with coaxial cylindrical conductors.

The accelerator according to the invention and which is diagrammatically shown in FIG. 4 comprises a resonant cavity 48 of the Rhodotron type, whereof examples are given in documents (1) and (2) and in FIGS. 1 and 2.

Thus, the cavity 48 comprises an external cylindrical conductor 50 and an internal cylindrical conductor 52, which are coaxial to one another.

The accelerator of FIG. 4 also comprises means 54 for forming and injecting into the cavity 48 an electron beam 56, which it is wished to accelerate with the accelerator of FIG. 4 and means 58 for forming and injecting into the cavity 48 an electron or generating beam 60 for losing part of its energy in the cavity 48 in order to supply the latter with electromagnetic energy.

As for the cavity of a Rhodotron (registered trade mark), the external and internal conductors 50, 52 respectively have diametrically opposite openings enabling the beams 56 and 60 to traverse the cavity 48.

The accelerator also has electron deflectors 62 permitting the recirculation of the beam 56, as in a Rhodotron.

In the embodiment shown in FIG. 4, the beam 56 which it is wished to accelerate consequently traverses the cavity 48 several times and therefore performs several passages in the latter forming a rosette. In this embodiment, the generating beam 60 only traverses the cavity 48 once, thus performing a single passage in said cavity.

FIG. 4 shows the opening 64 of the external conductor 50 by which exits the accelerated beam 56 and which is then usable for the desired application. A description will be given hereinafter of the production of the electron beams 56 and 60.

Various points will subsequently be made concerning the acceleration and deceleration of electron bunches in the cavity 48. The "radial" resonance mode of the cavity 48 only involves a radial electrical field Er and an azimuthal magnetic field Ha.

These fields Er and Ha are given by the following formulas:

$$Er=(V/r)\cdot\cos(z\cdot pi/L)\cdot\cos(2pi\cdot F\cdot t)$$

$$Ha=(V/r)\cdot(2L\cdot Mo\cdot F)^{-1}\cdot\sin(z\cdot pi/L\cdot\sin(2pi\cdot F\cdot t)$$

in which:

pi represents the well known number equal to about 3.14,

V is a constant having the dimension of a potential, t represents time,

F represents the resonant frequency of the cavity,

Mo is equal to $4pi\cdot10^{-7}$, z represents an abscissa on the axis of the cavity, L represents the cavity length along its axis, and r represents an abscissa on a transverse axis perpendicular to the cavity axis.

The number z is between $-L/2$ and $+L/2$.

Figure 5:
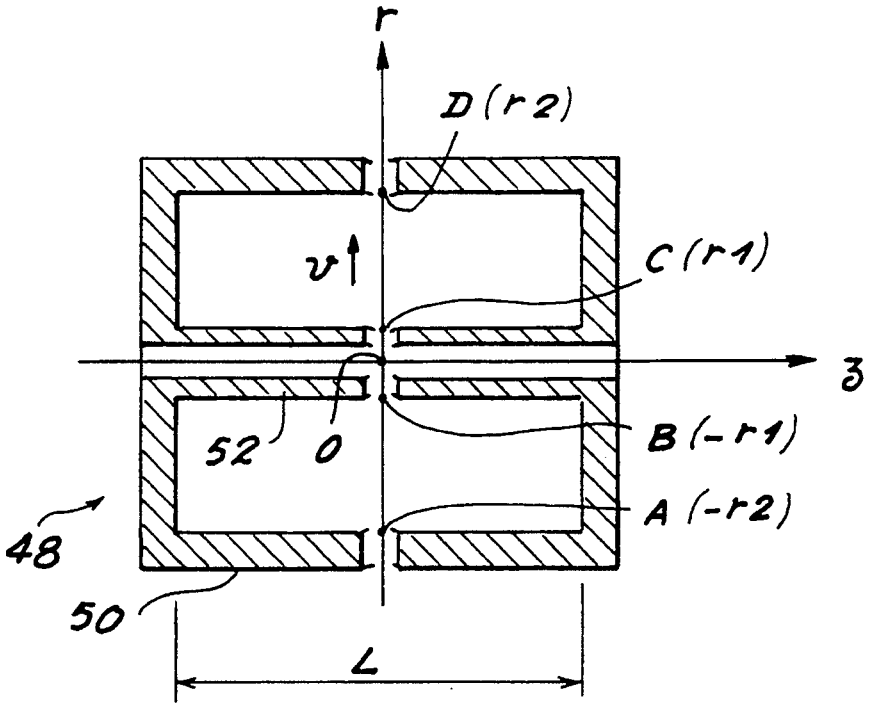
FIG. 5 A diagrammatic, longitudinal sectional view of the cavity of FIG. 4.

As can be seen in FIG. 5, where 0 represents the centre of the cavity, on traversing the axis on which the abscissa r appears, the latter passes from a minimum value $-r2$ on the external conductor to a value $-r1$ on the internal conductor and then to the value r1 on the internal conductor and finally to the value r2 on the external conductor.

The cavity 48 has a resonant wavelength equal to 2L.

The mean value Wm of the energy stored in the cavity on a period $F^{-1}$ is given by the following formula:

$$Wm=(pi/2)Eo\cdot V^2\cdot L\cdot Ln(r2/r1)$$

in which Eo represents the dielectric constant of the vacuum.

Assuming that an electron bunch enters the cavity 48, in the median plane thereof and along one diameter and with a given phase (relative to the electromagnetic field present in the cavity), the interaction of these electrons with said field supplies an energy quantity dW to cavity during one passage.

If for each period $F^{-1}$ of the field injection takes place with the same input phase of an identical electron bunch, the electromagnetic field of the cavity is supplied with a "generating" power, whose mean value on a period $F^{-1}$ is designated Pg.

The balance of the mean power gained by the cavity during this period is therefore written:

$$dWm/dt=Pg-Pj=Pg-(2pi\cdot F/Q)Wm$$

in which Pj represents the cavity losses by the Joule effect in the walls of said cavity and Q represents the overvoltage coefficient, which can be calculated as a function of L, r1, r2 and the skin thickness of the metal from which these walls are formed at the frequency F. The value of Pg will be given hereinafter.

Consideration will now be given to an electron traversing the cavity 48 in accordance with one diameter thereof, in the median plane of said cavity, openings being provided for this purpose on the cavity conductors 50 and 52 (cf. FIG. 5). The electron successively passes the points A, B, C and D, whose abscissas are respectively $-r2$, $-r1$, r1 and r2 on the axis of r.

It is possible to write the following equation system:

$$g(g^2-1)^{-\frac{1}{2}}\cdot dg/dt=-|e|\,V(mo\cdot c)^{-1}\cdot r^{-1}\cdot\cos(2pi\cdot F\cdot t)$$

$$v=dr/dt=c(g^2-1)^{\frac{1}{2}}\cdot g^{-1}$$

$$g=(1-v^2/c^2)^{-\frac{1}{2}}$$

In this system:

|e| represents the absolute value of the electron charge, mo represents the rest mass of the electron and c represents the speed of light in the vacuum.

This equation system makes it possible to evaluate the energy of the electron in the intervals AB and CD.

When the electron remains relativistic throughout the passage from A to D, it is possible to express the variation Dg of the energy of the electron during the path AD by the following formula:

$$Dg=gD-gA=2|e|\cdot V\cdot(mo\cdot c^2)^{-1}\cdot IAB\cdot\sin\phi o$$

In order to establish this formula, consideration is given to the phase $\phi$ of the electromagnetic field at a time t and the phase $\phi o$ of said electromagnetic field at the time to, when the electron passes into 0. The phases $\phi$ and $\phi o$ are given by the following formulas:

$$\phi=2pi\cdot F\cdot(t-to)$$

$$\phi o=2pi\cdot F\cdot to$$

In the formula given hereinbefore, gD and gA respectively represent the energy of the electron in D and the energy of the electron in A. IAB is the integral of the function $(\sin\phi)\cdot\phi^{-1}$ between the values $\phi A$ and $\phi B$. These values respectively correspond to the value of the phase $\phi$ when the electron passes into A and to the value of said phase $\phi$ when the electron passes into B.

The expression of the energy variation Dg is appropriate for the physical discussion of the electron deceleration or acceleration process.

Thus, the energy exchange between an electron traversing the cavity 48 and the electromagnetic field is expressed by an energy transfer function Dg, which can be either positive, or negative, or zero, as a function of the phase $\phi o$.

When Dg is positive, the electron is accelerated and takes energy from the cavity. When Dg is negative, the electron is decelerated and supplies electromagnetic energy to the cavity 48.

This energy transfer function is given hereinbefore when v is close to c, but must be numerically calculated on the basis of the aforementioned equation system when v differs significantly from c.

The maximum energy gain of the electron is obtained from the formula giving Dg by replacing $\phi o$ by:

$$pi/2+2K\cdot pi$$

in which K is a positive, negative or zero integer.

The maximum energy loss of the electron is obtained from the formula giving Dg by giving to $\phi o$ the following value:

$$3pi/2+2K\cdot pi$$

The maximum $|Dg|$ max of the absolute of Dg is then given by the following formula:

$$|Dg|max=2|e|\cdot V\cdot IAB\cdot(mo\cdot c^2)^{-1}$$

Figure 6:
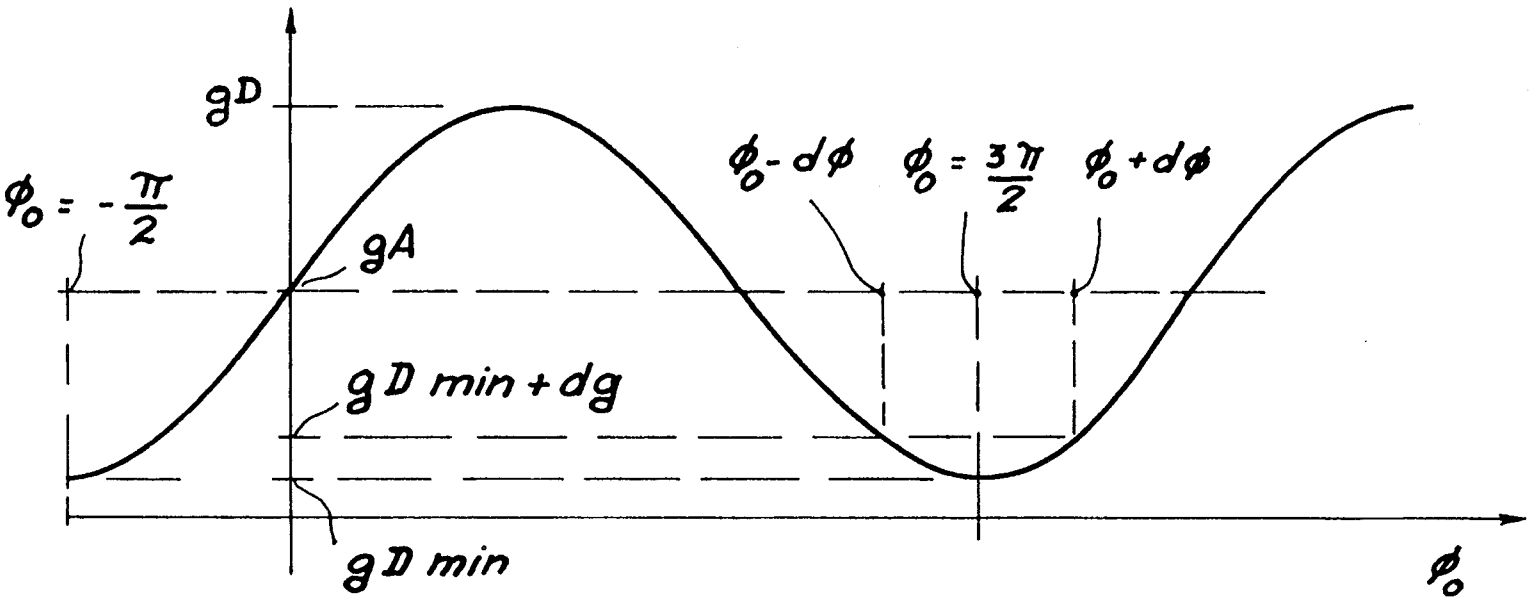
FIG. 6 A graph explaining the phase conditions to be obtained for the operation of the accelerator of FIG. 4.

FIG. 6 shows the energy gD of the electron when it leaves the cavity 48, as a function of the phase $\phi o$.

It can be seen that under certain conditions the electron can lose all its initial energy and does not pass out of the cavity after its first passage. This would be the case if gA was equal to or below $|Dg|$ max .

In practice, the aim is to avoid this situation and electrons of the generating beam 60 are injected into the cavity 48 with an initial energy gA exceeding the said threshold $|Dg|$ max, if not these electrons would accumulate in the cavity and a disturbing plasma would form therein.

Consideration will now be given to the real case where not a single electron, but an electron bunch with a phase width $\pm d\phi$ is injected into the cavity 48 and then one is in the vicinity of:

$$\phi o=3\ pi/2+2K\cdot pi$$

The electrons then pass out of the cavity at D with an energy in the range:

$$(gDmin,\ gDmin+dg)$$

The quantity dg differs only slightly from:

$$|e|\cdot V\cdot IAB\cdot(mo\cdot c^2)^{-1}\cdot(d\phi)^2$$

In the case where the generating beam only performs a single passage in the cavity, if it is wished that the thus injected electrons give off almost all their energy and exit with a limited energy dispersion, gA must slightly exceed:

$$2|e|\cdot V\cdot IAB\cdot(mo\cdot c^2)^{-1}$$

and $d\phi$ differs only slightly from:

$$(dg/gA)^{178}$$

A calculation will now be made of the power Pg referred to hereinbefore or, and this amounts to the same thing, the power lost by an electron beam traversing the cavity from A to D.

Figure 7:
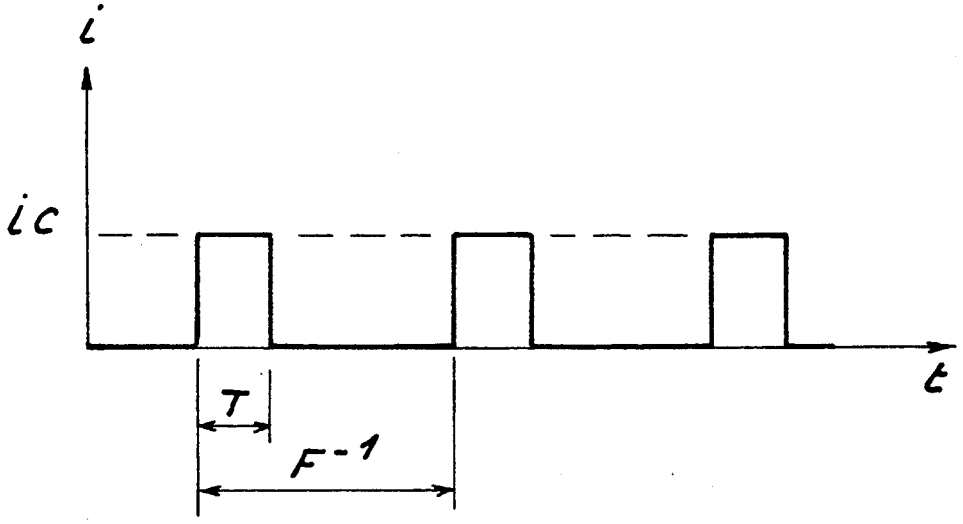
FIG. 7 The current pulses corresponding to the generating beam making it possible to supply with electromagnetic energy the cavity of the accelerator of FIG. 4.

Consideration will be given to an electron beam constituted by a current pulse train i, whose peak current is designated ic and whose width is designated T (cf. FIG. 7). Each pulse is separated from the preceding pulse by a time equal to $F^{-1}$. It is then possible to determine the total energy lost by the electrons of a complete pulse and then determine the power Pg.

In order to do this, it is pointed out that there are identical pulses per time unit and account is taken of the fact that the phase $\phi o$ corresponding to the maximum deceleration of the generating beam is equal to:

$$\phi o=-pi/2+2K\cdot pi$$

We then obtain:

$$Pg=(2\cdot ic/pi)\cdot(V\cdot IAB\cdot mo^{-1}\cdot c^{-2})\cdot Sin(pi\cdot F\cdot T)$$

It is then possible to write:

$$Pg=2\langle i\rangle\cdot V\cdot IAB\cdot(mo\cdot c^{-2})^1$$

in which $\langle i\rangle$ represents the mean current transported by the generating beam.

We will now return to the accelerator shown in FIG. 4. It is pointed out that the generating beam 60 is a train of electron bunches emitted at regular time intervals $F^{-1}$. Typically F is between 100 and 200 MHz. The duration T of these pulses is short compared pared with $F^{-1}$and does not exceed $10^{-1}\cdot F^{-1}$.

The emission of the pulses of the generating beam is phase tuned with respect to the high frequency electromagnetic field of the cavity 48, so as to respect the value $\phi o$ corresponding to the maximum deceleration of the electron bunches.

The means 58 for the formation and injection of the beam 60 comprise a cathode 66, a control grid 68 and an electrostatic accelerating tube 70 making it possible to accelerate said generating beam 60.

The formation of the electron bunches is ensured by the cathode 66 and control grid 68, which is synchronized with the high frequency field of the cavity 48. The beam 56 which it is wished to accelerate is constituted by electron bunches, which are separated from one another by a time $F^{-1}$ and whose duration T is short compared with $F^{-1}$, T not exceeding $10^{-1}\cdot F^{-1}$.

The means 54 for the formation and injection of the beam 56 comprise a cathode 72 which emits the electrons of the beam 56, a grid 74 which controls the emission time of the electron bunches and an electrostatic accelerating tube 76. The latter preaccelerates the beam 56, which is then injected into the cavity 48 to be accelerated there.

The emission phase of the electron bunches of the beam 56 must be perfectly tuned to the value leading to the maximum acceleration of the electrons in the cavity 48.

In this connection it is pointed out that the accelerator comprises, in the cavity 48, a HF probe, e.g. constituted by a measuring loop 78, which measures the electromagnetic field in the cavity.

The accelerator of FIG. 4 also comprises an amplifier 80, which amplifies the signal from said probe and which supplies control pulses synchronous with the oscillations of the cavity and which trigger the emission of electron bunches of each beam with an appropriate phase shift, as defined hereinbefore, between said two emissions.

The accelerator of FIG. 4 also comprises an electron collector 82 for collecting the electrons from the generating beam after the passage thereof in the cavity 48. The collector 82 can be preceded by a deflecting tube 84, as shown in FIG. 4 for decelerating the electrons before they are collected. This makes it possible to recover the residual energy of the electrons and to use same in the form of electrical power with a view to improving the energy efficiency of the installation.

In the embodiment shown in FIG. 4, the accelerating tubes 70, 76 are advantageously placed on two adjacent openings of the cavity 48. Such an arrangement makes it possible to use the same high voltage generator 86 for accelerating the generating beam 60 and preaccelerating the beam 56.

The generator 86 can be a high voltage source with electron multiplication of voltage of the Greinacher type. This high voltage source is e.g. of the type described in document (4).

In general, the high voltage applied to the two accelerating tubes 70 and 76 is a few hundred kV, namely approximately 1MV.

In this case, said tubes 70, 76 and all the high voltage electronic equipment are placed in a tight enclosure 88, which is pressurized by gaseous $SF_6$, in order to prevent electrical breakdowns. Generally, the collector 82 and the tube 84 are not protected by such a $SF_6$ atmosphere.

However, if it is wished to recover with a good efficiency the energy of the electrons of the exiting generating beam, it is necessary to polarize the decelerating electrodes to voltages, which may require such a protection. Then, the collector 82 and the tube 84 are also placed in such a pressurized tight enclosure 90.

It is pointed out that the production of sufficiently short pulses and appropriately synchronized with the level of the injection into the accelerating tubes 70 and 76 is made possible by a cathode/grid system similar to those described in documents (5) and (6) Typically the cathode/grid systems Eimac Y646B or Eimac Y796 make it possible to control the emission of 2A peak currents for pulses with a duration below $10^{-9}$s.

Figure 8:
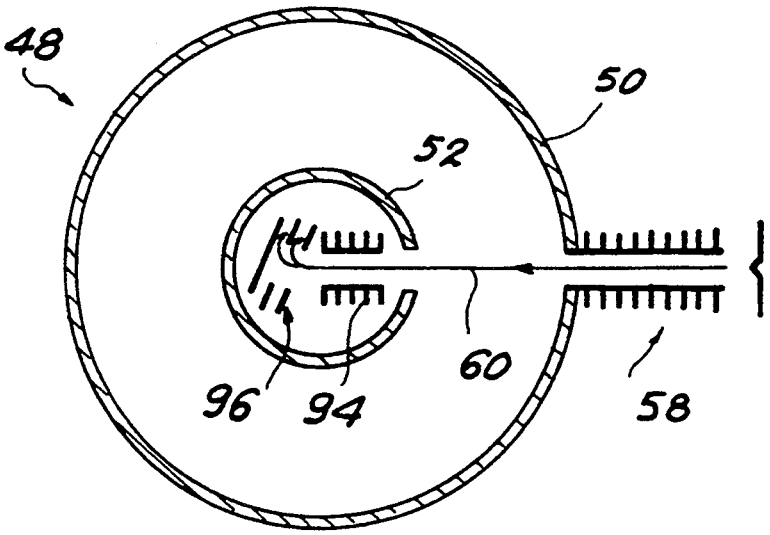
FIG. 8 Diagrammatically a special embodiment of the invention, in which the said beam only performs a "half-passage" in said cavity.

In a constructional variant of the accelerator according to the invention and which is diagrammatically and partly shown in FIG. 8, the generating beam 60 only traverses the cavity 48 in accordance with a half-diameter thereof. Such an arrangement has the interest of dividing by two the high voltage of the electrostatic accelerator provided for forming the beam Then, for an accelerator according to the invention, communicating 1 MeV per passage of the electrons which it is wished to accelerate in the cavity, it is sufficient to inject a generating beam, whose energy is approximately 500 KeV.

As shown in FIG. 8, means for the recovery of the beam 60 and constituted by a decelerating tube 94, followed by an electron collector 96 are then located within the cylindrical conductor 52.

However, to ensure that the said beam recovery means do not intercept the trajectories of the beam which it is wished to accelerate, it is then necessary to inject the generating beam 60 outside the median plane of the cavity, which is then reserved for the beam which it is wished to accelerate. The generating beam is slowed down substantially in the manner described hereinbefore.

However, the magnetic field Ha produces a supplementary force, which is generally low if the injection of the generating beam does not take place too far from the median plane of the cavity 48. The supplementary force leads to a displacement, along z, of the exit point of the electrons of the generating beam. It is necessary to take account of this displacement along z in the positioning of the generating beam exit hole.

Figure 9:
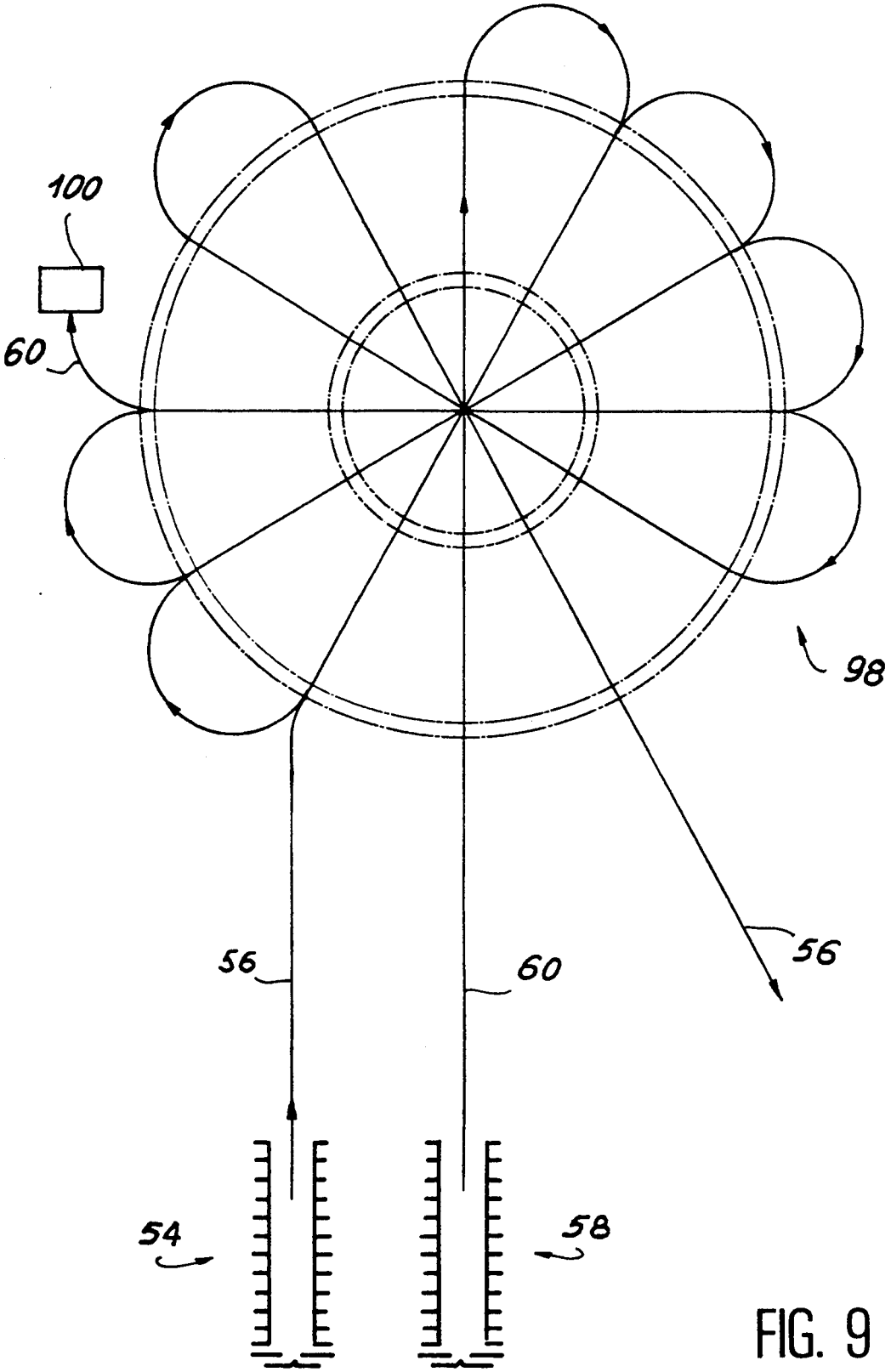
FIG. 9 Diagrammatically another embodiment in which the generating beam traverses said cavity more than once.

What has been stated hereinbefore in connection with the accelerator of FIG. 4 also applies to an accelerator according to the invention of the type diagrammatically and partly shown in FIG. 9. In this case consideration is given to a coaxial cavity 98 of the Rhodotron (registered trade mark) type operating at 1 MeV per passage.

A generating beam 60 is injected at 4 MeV and undergoes four decelerating passages, which supply the cavity 98 with electromagnetic energy, the beam 60 being recovered by appropriate means 100 when it leaves the cavity 98. The beam 56 which it is wished to accelerate penetrates at 4 MeV the cavity 98 and leaves it after five passages with an energy of 9 MeV.

More generally, it is possible to conceive accelerators according to the invention in which the generating beam performs N1 passages in the coaxial cavity, whilst the beam which it is wished to accelerate performs N2 passages in said cavity, N2 being equal to or greater than N1.

In the previously described embodiments, it should be noted that the resonant cavity serves as a "transformer", which uses a generally high intensity, low energy generating beam, as well as a beam to be accelerated, which generally has a lower intensity but higher exit energy. These two beams differ by the respective phases of their electron bunches, which are displaced by pi.

There is no integral transfer of the power transported by one of the beams into the power of the other beam, because the system has losses:

losses by the Joule effect in the cavity, electron losses of the beams on the walls thereof and energy losses during the recovery of the generating beam.

However, it should be noted that the electrostatic acceleration and deceleration are operations performed with very high efficiency levels. In this connection reference should be made to document (7), where reference is made to recovery efficiencies exceeding 99.5%.

The invention can also be performed with other resonant cavities other than that used in a Rhodotron (registered trade mark). However, the structure of the cavity used should permit the passage of the generating beam.

Moreover, as it is preferable that the electron pulses of said generating beam have a duration well below the period corresponding to the resonant frequency of the cavity, this will be more easy to achieve as the resonant frequency of said cavity decreases. In exemplified manner, a cavity with a resonant frequency below approximately 200 MHz is suitable.

Figure 10:
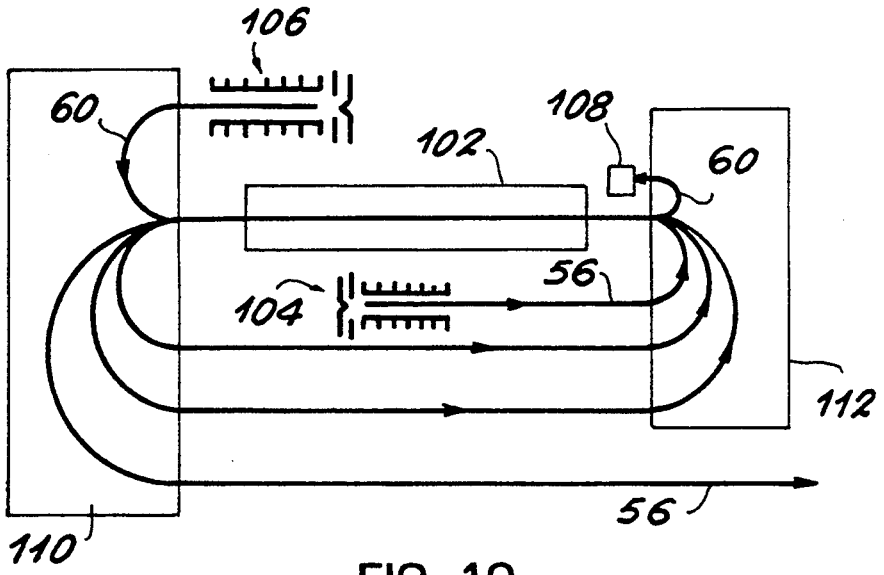
FIG. 10 Diagrammatically another embodiment of the invention using a linear structure with at least one resonant cavity.

It is e.g. possible to produce an accelerator according to the invention using at least one accelerating cavity of the type used in linear accelerators (Linac). This is illustrated by FIG. 10, where an accelerator according to the invention is diagrammatically shown. Thus, this accelerator has a linear accelerating structure 102 with at least one resonant cavity, means 104 for producing and injecting the beam 56 which it is wished to accelerate and means 106 for producing and injecting the generating beam 60.

In the represented embodiment, the beam 56 is injected by one end of the structure 102 and performs several passages in said structure during which its energy increases, whilst the generating beam 60 is injected by the other end of the structure and performs a single passage therein, after which it is collected by appropriate means 108.

Moreover, the accelerator of FIG. 10 comprises, on either side of the structure 102, magnetic deflectors 110, 112 ensuring the deflection of the beam 56, so that it can perform its passages through the structure 102. The deflectors 110, 112 also deflect the beam 60, so that it can be injected into the structure, followed by a further deflection of said beam 60 when it leaves the structure 102, in order to supply it to the collecting means 108.

Figure 11:
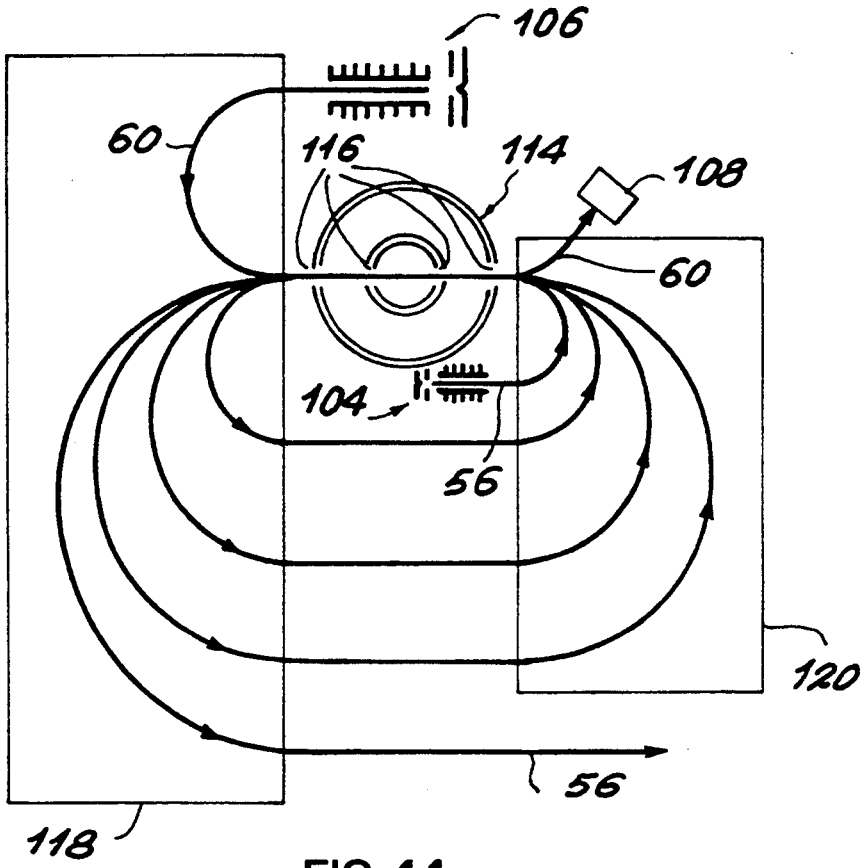
Fig. 11 A diagrammatic view of another special embodiment using a cavity like a Rhodotron (registered trade mark) and in which the generating beam only performs a single passage.

FIG. 11 diagrammatically shows another accelerator according to the invention, which has a coaxial cavity 114 of the type used in a Rhodotron (registered trade mark).

There are only four openings 116 in said cavity, namely two diametrically opposite openings on the internal conductor and two diametrically opposite openings on the external conductor, said four openings being aligned. Thus, a diameter of the cavity is defined and this is followed by the generating beam 60 and by the beam 56 which it is wished to accelerate.

The generating beam 60 from the production and injection means 106 only performs a single passage in the cavity 114 following said diameter and on leaving the cavity is collected by appropriate means 108.

As shown in FIG. 11, the beam 56 from the production and injection means 104 performs several successive passages in the cavity 114 in accordance with the said diameter.

As shown in FIG. 11, the beam 60 is injected at one end of said diameter, whereas the beam 56 is injected at its other end.

FIG. 11 also shows magnetic deflectors 118, 120 located on either side of the cavity 114 and which deflect the generating beam 60 for the injection thereof into the cavity 114 and also at the exit from said cavity in order to supply it to the collecting means 108.

The deflectors 118, 120 also deflect the beam 56 in order to inject it into the cavity 114 and to deflect the beam 56, so that it can perform its successive passages in the cavity 114, the energy of the beam 56 increasing on each passage, as can be seen in FIG. 11.

The documents cited in the present description are as follows:

(1) French patent application 8707378 of 26.5.1987, entitled "Coaxial Cavity Electron Accelerator".
(2) French patent application 8910144 of 27.7.1989 entitled "Improved Electron Accelerator Free Electron Laser".
(3) De la physique des particules à l'agroalimentaire, La Recherche, December 1990. vol.21, p.1464.
(4) French patent application 8910653 of 8.8.1989, "Electrostatic Electron Accelerator", invention of Michel ROCHE, cf. also EP-A-0 412 896.
(5) S. V. Benson et al., Status Report on the Stanford Mark III Infrared Free Electron Laser, 9th International Conference on free electron lasers, Williamsburg, September 1987.
(6) J. C. Bourdon et al., Commissioning the CLIO Injection System, Nuclear Instruments and Methods in Physics and Research, A 304 (1991), pp. 322 to 328.
(7) L. R. Elias, Electrostatic accelerators for free electron lasers, Nuclear Instruments and Methods in Physics and Research, A287 (1990), pp.79 to 86.

We claim:

1. Electron accelerator for accelerating a first electron beam, comprising:

at least one resonant cavity;

means for supplying said at least one resonant cavity with an electromagnetic field at a resonant frequency of said at least one resonant cavity, said means for supplying comprising means for forming a second electron beam and for injecting said second electron beam into the resonant cavity, in the form of pulses, at times where the resonant cavity functions to decelerate the electrons of the second electron beam; and means for forming the first electron beam and for injecting said first electron beam into the resonant cavity, in the form of pulses, in phase opposition to the second electron beam and along a trajectory that is different from a trajectory of the second electron beam.

2. Accelerator according to claim 1, wherein a duration of the pulses of the first and second electron beams during the injection thereof is at the most equal to approximately 1/10 of the period of the electromagnetic field.

3. Accelerator according to claim 1, wherein the energy of the electrons of the second electron beam during the injection thereof exceeds the energy threshold below which said electrons remain trapped in the resonant cavity.

4. Accelerator according to claim 1, wherein the means for forming and injecting the first and second electron beams comprises a plurality of electrostatic accelerating tubes and at least one high voltage generator for preaccelerating the first electron beam and accelerating the second electron beam.

5. Accelerator according to claim 4, wherein said high voltage generator is a high voltage source with electron multiplication of voltage of the Greinacher type.

6. Accelerator according to claim 4, wherein;

the resonant cavity comprises an external cylindrical conductor and an internal cylindrical conductor, which are coaxial with one another and have openings for introducing into and extracting from the resonant cavity the first and second electron beams; and the accelerator further comprises at least one electron deflector for deflecting an electron beam having traversed the resonant cavity along one diameter and for reinjecting said electron beam having traversed the resonant cavity along one diameter into the cavity along a further diameter; and wherein the electrostatic accelerating tubes are positioned facing openings of the external cylindrical conductor, which are adjacent to one another.

7. Accelerator according to claim 6, further comprising a tight enclosure in which are placed the electrostatic accelerating tubes and the high voltage generator, said high voltage generator being pressurized by a gas forming a dielectric.

8. Accelerator according to claim 1, wherein:

the resonant cavity comprises an external cylindrical conductor and an internal cylindrical conductor, which are coaxial and have openings for the introduction into and extraction from the resonant cavity of the first and second electron beams; and the accelerator comprises at least one electron deflector for deflecting an electron beam which has traversed the resonant cavity along one diameter and for reinjecting said electron beam which has traversed the resonant cavity along said one diameter into the resonant cavity along another diameter.

9. Accelerator according to claim 8, wherein;

the external cylindrical conductor has an opening for the introduction into the cavity of the second electron beam and the internal cylindrical conductor having an opening facing the opening of the external cylindrical conductor; and the accelerator further comprising means for receiving the second electron beam said means for receiving located within the internal cylindrical conductor and facing its opening.

10. Accelerator according to claim 1, wherein said accelerator has a linear accelerating structure comprising said at least one resonant cavity and means for injecting the first and second electron beams into the linear accelerating structure respectively, by a first end of said at least one resonant cavity and by a second end of said at least one resonant cavity.

11. Accelerator according to claim 1, wherein;

the resonant cavity comprises an internal cylindrical conductor and an external cylindrical conductor, which are coaxial, the external cylindrical conductor having two diametrically opposite openings, the internal cylindrical conductor also having two diametrically opposite openings aligned with the openings of the external cylindrical conductor, and means for injecting the first electron beam and second electron beam into the resonant cavity, respectively, by one of the openings of the external conductor and by the other one of the external openings of the external conductor.

12. Accelerator according to claim 1, further comprising;

a high frequency probe placed in the resonant cavity for measuring the electromagnetic field in the resonant cavity; and means for forming pulses for the control of the formation of the first and second electron beams and means for injecting the first and second electron beams in response to a signal supplied by the high frequency probe.

* * * * *